US010118743B2

(12) United States Patent
Liberati

(10) Patent No.: US 10,118,743 B2
(45) Date of Patent: Nov. 6, 2018

(54) MECHANICAL CLOSURE FOR BOTTLES

(71) Applicant: TAPÌ S.P.A., Massanzago (PD) (IT)

(72) Inventor: Domenico Liberati, Massanzago (IT)

(73) Assignee: TAPÌ S.P.A., Massanzago (PD) (IT)

( * ) Notice: Subject to any disclaimer, the term of this patent is extended or adjusted under 35 U.S.C. 154(b) by 47 days.

(21) Appl. No.: 15/128,312

(22) PCT Filed: Mar. 23, 2015

(86) PCT No.: PCT/EP2015/056135
§ 371 (c)(1),
(2) Date: Sep. 22, 2016

(87) PCT Pub. No.: WO2015/144642
PCT Pub. Date: Oct. 1, 2015

(65) Prior Publication Data

US 2017/0190480 A1 Jul. 6, 2017

(30) Foreign Application Priority Data

Mar. 24, 2014 (IT) ..... PD2014A0067

(51) Int. Cl.
*B65D 45/24* (2006.01)
*B65D 45/06* (2006.01)
*B65D 55/06* (2006.01)

(52) U.S. Cl.
CPC ..... *B65D 45/06* (2013.01); *B65D 45/24* (2013.01); *B65D 55/06* (2013.01); *B65D 2101/0007* (2013.01); *H05K 999/99* (2013.01)

(58) Field of Classification Search
CPC ..... B65D 45/06; B65D 55/06; B65D 45/24
USPC ..... 215/239
See application file for complete search history.

(56) References Cited

U.S. PATENT DOCUMENTS 4,009,794 A * 3/1977 Zapp ..... B65D 45/06 215/210
2012/0091160 A1* 4/2012 Rognard ..... B65D 47/0842 220/835

FOREIGN PATENT DOCUMENTS

DE 202005009355 U1 9/2005
GB 2254070 A 9/1992

OTHER PUBLICATIONS

International Search Report and Written Opinion issued in corresponding International Application No. PCT/EP2015/056135, dated Aug. 21, 2015.

* cited by examiner

*Primary Examiner* — James N Smalley
(74) *Attorney, Agent, or Firm* — Andrus Intellectual Property Law, LLP

(57) ABSTRACT

A mechanical closure for includes a cap hinged in an oscillating manner about an axis, a pair of tie-rods respectively articulated at their first end on opposite sides of the cap with respect to the axis and hinged at their opposite second end on a corresponding first end of a respective arm. Each arm is provided at its second opposite end with a respective pin the pins being coaxial and intended to hinge the arms on a neck of a bottle. An arc connects the arms to one another so that the arms may be jointly actuated to rotate about the respective pin. The mechanical closure includes a tamper indicator provided to indicate the first opening of the mechanical closure includes a band which interconnects the arms and/or the tie-rods on the side opposite the arc so as to prevent the arms from oscillating about the respective pins.

20 Claims, 2 Drawing Sheets

MECHANICAL CLOSURE FOR BOTTLES

CROSS-REFERENCE TO RELATED APPLICATIONS

This application is the U.S. national stage application of International Application PCT/EP2015/056135, filed Mar. 24, 2015, which international application was published on Oct. 1, 2015, as International Publication WO2015/144642 in the English language. The international application is incorporated herein by reference, in entirety. The international application claims priority to IT Patent Application No. PD2014A000067, filed Mar. 23, 2014, which is incorporated herein by reference, in entirety.

The present invention relates to a mechanical closure for bottles and the like of the type including the features set out in the preamble of the main claim.

Such closures, which are also known as swing caps, typically comprise a pair of arms which can be hinged to the neck of a bottle so as to be able to oscillate with respect to the relative fulcrum between an open position and a closure position. The closure further comprises a arc which extends in a bridge-like manner between the arms and which is provided to move away from the neck of the bottle when the arms are oscillated towards the open position and alternatively to move towards the neck of the bottle when the arms are oscillated towards the closure position.

The closure further includes a cap which is hinged between a pair of tie-rods which are generally formed by a metal wire which is folded in a U-shaped manner, the prongs of which are articulated by means of the central bridge-like member to the arms.

When the arms are oscillated towards the closure position, the tie-rods apply a closing pressure to the cap so that the cap is pressed against the mouth of the bottle. Otherwise, when the arms are oscillated towards the open position, the cap is moved away from the mouth.

Within the specific technical field, it is known to apply an adhesive label to the closed bottle in order to provide evidence of the first opening. The label normally involves the arc of the closure being removed or torn away in this manner in the event of the first opening of the bottle, thereby acting as a tamper indicator.

An example of this technology is described in GB2254070. However, those solutions are not particularly suitable for adequately demonstrating the occurrence of the opening of the bottle because the label or the edges thereof can be readily re-applied to the bottle, hiding the occurrence of opening or at any rate making it very imperceptible.

It is further evident that, although the cap is not removed from the bottle, the label can readily be subjected to accidental tears if the bottle is handled in an incorrect manner, for example, if it is gripped in the region of the cap, therefore becoming very unreliable for the purpose of tamper indication in respect of the bottle.

Another problem involves the fact that those closures do not incorporate per se a tamper indicator, requiring for that purpose the application of a label or other similar element after the cap has been placed on the bottle.

A device comprising a collar which can be opened in order to fix a mechanical closure to a bottle is described in DE 20 2005 009355 U1.

In recent years, it has further been established that consumers place increasingly great value on the overall aesthetic appearance of the bottle (that is, the bottle including the cap), in particular when the bottles contain high-quality alcoholic beverages. The consumers are thus led to purchase a bottle not only as a result of the quality of the content, but also by the appeal of the aesthetic characteristic thereof.

The technical problem addressed by the present invention is therefore to provide a closure for bottles which is structurally and functionally configured to overcome all the disadvantages set out with reference to the cited prior art.

This problem is solved by a closure for bottles and similar containers including the features set out in claim 1. Preferred features of the invention are defined in the dependent claims.

The invention according to the present invention allows the construction of a closure for bottles and similar containers which is provided with a tamper indicator which is reliable, robust and which clearly indicates the occurrence of first opening of the bottle.

The features and additional advantages of the invention will be better appreciated from the following detailed description of a preferred but non-limiting embodiment thereof which is illustrated by way of non-limiting example with reference to the appended drawings, in which.

Figure 1:
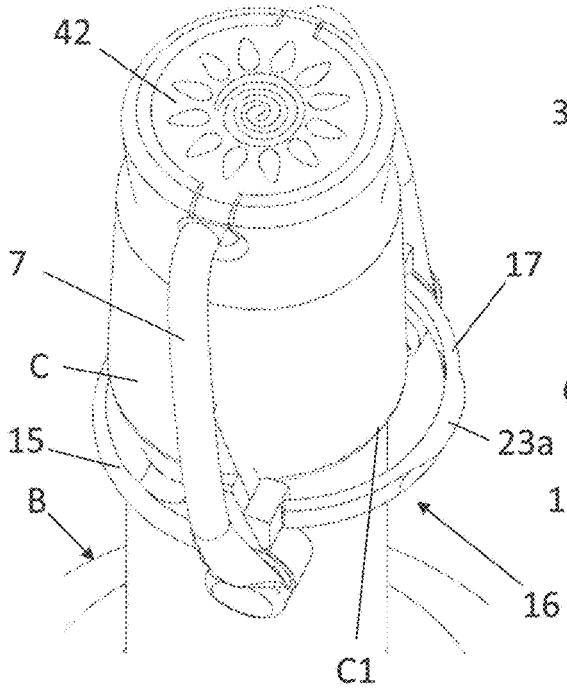
FIG. 1 is a perspective view of a partial bottle which is closed by a mechanical closure according to the invention.

In FIG. 1, there is designated B a bottle (only partially illustrated) whose neck C is provided with two seats S opposite each other.

A mechanical closure for bottles or similar containers which is generally designated 1 comprises a cap 3 which is provided with a transverse channel 41 which is closed at the upper side by a cover 42 so as to define a through-hole 4.

The cover 42 is in the form of a disc and may carry a distinctive sign of the producer or the beverage contained in the bottle 1.

There extends in the hole 4 a central bridge-like member 6 of a structure 5, which is preferably generally in the form of an inverted U. The bridge-like member acts as a pin, with which the cap 3 is hinged in an oscillating manner about an axis X.

Figure 3:
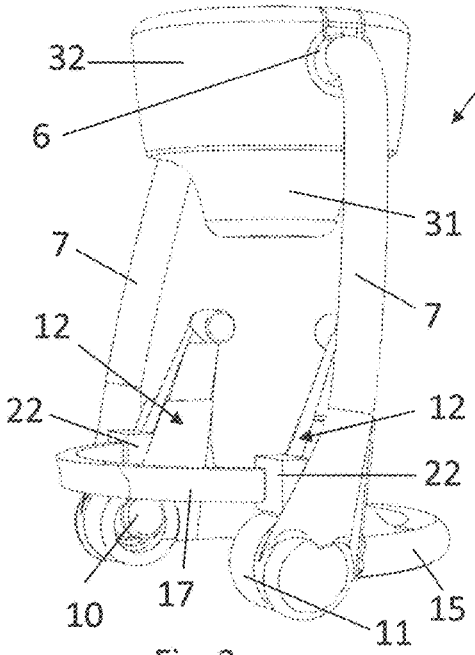
FIGS. 3 and 4 are perspective views of a mechanical closure according to the invention according to different viewpoints.
Figure 4:
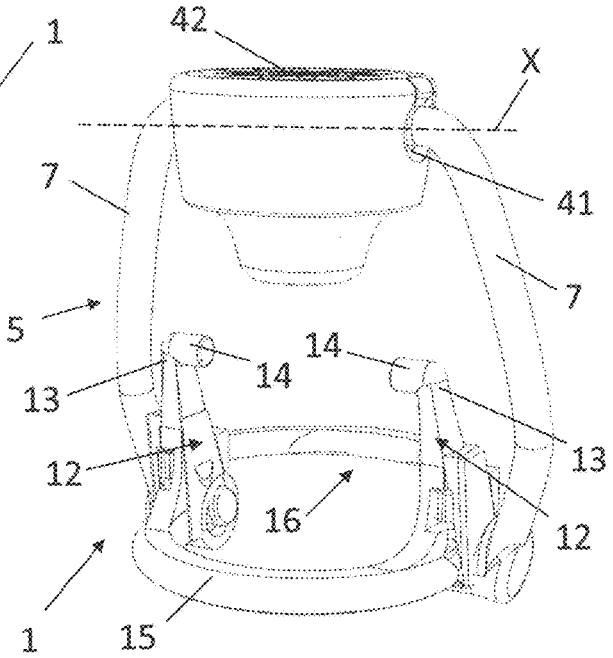
Figure 5:
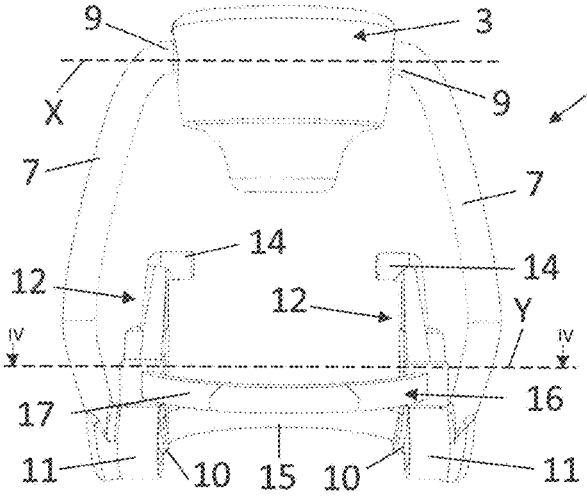
FIG. 5 is a front view of a mechanical closure according to the invention.

At the opposing sides of the central bridge-like member 6, the U-like structure forms respective tie-rods 7 which are fixedly joined to each other via the common connection to the central bridge-like member 6 so as to be hinged at opposing sides of the cap 3, respectively, with respect to an oscillation axis X at a first end 9 thereof. Furthermore, as may be observed in FIGS. 3 to 5, the tie-rods 7 are hinged at an opposite second end 10 on a corresponding first end 11 of a respective arm 12.

Preferably, the cap 3 comprises a stem 31 which extends axially from a head 32. According to a preferred embodiment, the stem 31 and head 32 of the cap 3 are advantageously constructed from foamed resin, whose deformation capacity ensures the fluid-tight closure of the bottle 1 without any need for annular seal on the stem 31.

Each arm 12 is provided at its second end 13 opposite the first end 11 with a respective pin 14. As may be observed in FIGS. 3 to 5, the extent of the tie-rods 7 and the arms 12 is such that the pins 14 are arranged so as to be mutually coaxial and to face each other. In this manner, the pins 14 can engage in a rotatable manner with the respective seats S, causing the arms 12 to be hinged on the bottle neck C.

The arms 12 are fixedly connected to each other by an arc 15 which is provided so that the arms 12 are jointly actuated to rotate about the respective pin 14. The arc 15 further serves to limit the oscillation of the arms 12 on the pins 14, going into contact with the neck C of the bottle shortly after an oscillation dead point, which is better defined below, has been overcome.

The closure according to the present invention further comprises a tamper indicator 16 which is provided to indicate the first opening of the mechanical closure 1 according to manners which will be set out in greater detail below. The tamper indicator comprises a band 17 which is connected at the opposing ends thereof to the arms 12 and which is arranged on the side opposite the arc 15 so as to prevent the arms 12 from oscillating about the respective pins 14. Preferably, the band 17 is interconnected at its opposite ends 18 in respective seats 19 which are formed in an intermediate portion of each of the arms 12 (and/or which is formed in an intermediate portion of the tie-rods 7) in order to be arranged at the opposite side to the arc 15. The band 17 is capable of being torn, or at any rate disengaged, from the arms 12 upon the first opening of the mechanical closure 1. In fact, with the band 17 being arranged at the opposite side to the arc 15, and since the cap 3 is moved into the open position by moving the arc 15 away from the neck of the bottle, the opening of the closure of the present invention may take place only as a result of movement apart of the band 17 and the arc 15. Therefore, it is evident that such a movement apart may take place only when the band 17 is removed or broken.

A first possibility set out by the invention for releasing the arms 12 is to break the band 17, for example, at one or more locally weakened areas 20, where, for example, the cross-section of the band 17 is narrowed with respect to the normal cross-section thereof.

A second possibility set out for releasing the arms 12 is to discharge, preferably as a result of irreversible damage, the ends 18 of the band 17 from the seats 19 of the arms 12.

There is provision for the band 16 optionally to be constructed in one piece with the arms 12 themselves.

In a preferred embodiment of the invention, the band 17 is capable of being torn or disengaged from the arms 12 when it is pressed towards the base of the bottle and/or is pulled away from the neck of the bottle with a sufficiently great force.

Furthermore, the band 17 is capable of being torn or disengaged from the arms 12 at the first actuation of the arc 15 when the mechanical closure 1 is opened.

Figure 2:
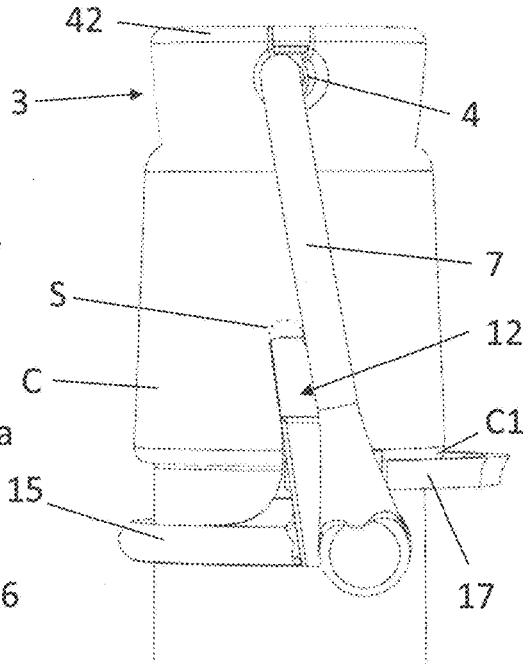
FIG. 2 is a side view of a partial bottle which is closed by a mechanical closure according to the invention.

With reference to FIG. 2, the band 17 is preferably interconnected with the arms 12 (and/or tie-rods 7) in such a position that it is disposed, in use, at a shoulder C1 present on the neck C of the bottle.

Fraudulent attempts to tamper with the mechanical closure 1, for example, by extracting the pins 14 of the arms 12 from the respective seats S of the neck C of the bottle, are opposed by the band 17 which is retained by the shoulder C1, blocking the sliding of the arms 12 on the neck of the bottle and consequently preventing access to the contents of the bottle.

It is preferable for the band 17 to be constructed as a separate entity from the remaining components of the closure 1 so as to be able to readily construct it in contrasting colours with respect to the other closure components. The arms 12, the tie-rods 7, the arc 15 and the band 17 are preferably constructed by being moulded from plastics material, which is optionally transparent and which allows inter alia particularly attractive construction from an aesthetic point of view. Differently, the known mechanical closure means, which are mainly constructed from zinc-plated steel wire, do not have features which are capable of conferring on the bottle a particularly pleasant aesthetic appearance.

According to an embodiment of the invention which is illustrated in FIGS. 3 to 6, the seats 19 of the arms 12 are defined by holes which are provided to receive the ends 18 of the band 17. Those seats 19 are preferably blind holes.

Each end 18 of the band 17 is provided with a hook 21 to form a resilient retention which is compressed when it is forced inside the respective hole 19 in order to engage with the seat 19 in a stable manner. In other words, the seats 19 are shaped so as to engage the respective hook 21.

The band 17, in the vicinity of each end 18 thereof, is further provided with a shoulder 22 which is arranged to abut the arms 12.

The locally weakened areas 20 of the band 17 are preferably constructed in the region of those shoulders 22 so that only the ends 18 of the band 17 remain connected to the arms 12 inside the respective seats 19 when the band 17 is broken by being torn.

Figure 8:
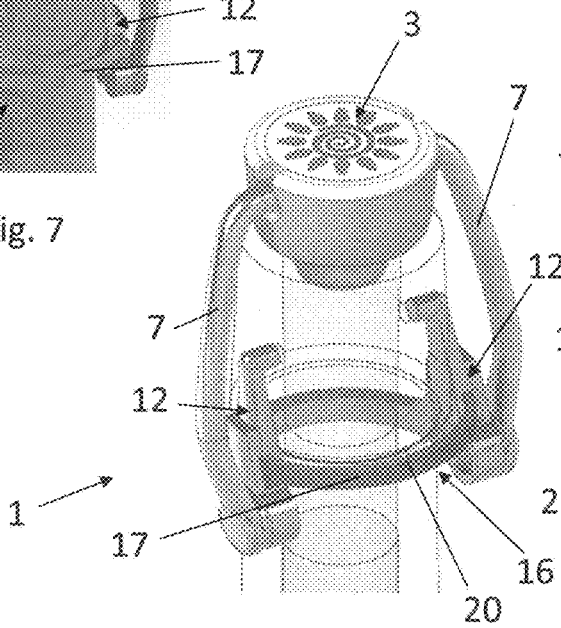
Figure 9:
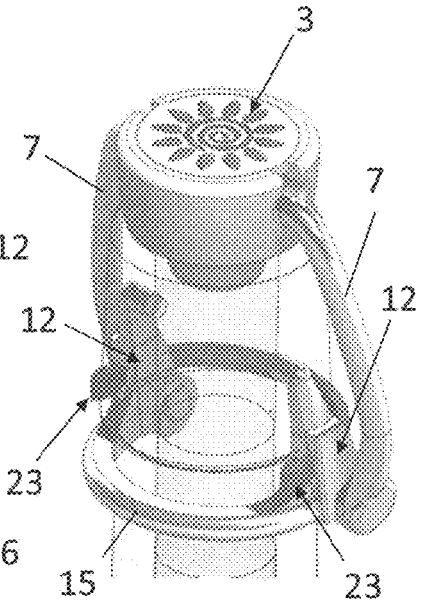

With reference to FIGS. 8 and 9, according to an alternative embodiment of the invention, the seats 19 are through-seats and each end 18 of the band 17 is provided with a one-way locking member 23 in order to obtain the interconnection between the band 17 and the arms 12.

Still with reference to FIGS. 8 and 9, the locally weakened areas 20 of the band 17 are constructed in an intermediate position between the ends 18 of the band 17 in order to assist in the breaking thereof.

Figure 6:
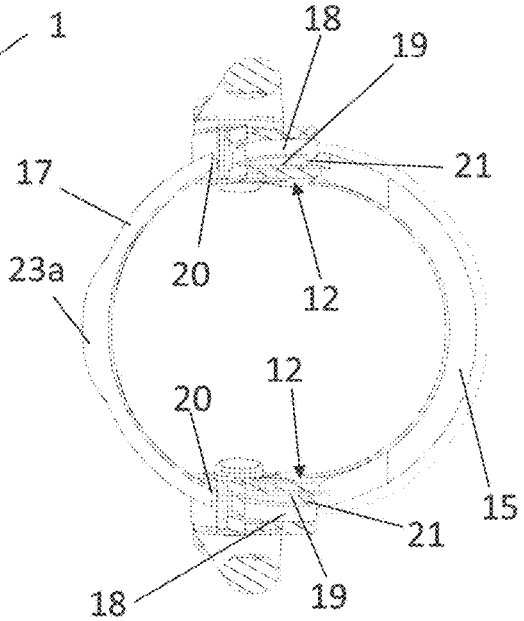
FIG. 6 is a cross-section of the mechanical closure of FIG. 5 which is obtained by means of the plane of section Y.

As illustrated, for example, in FIGS. 1 and 6, the band 17 may further have in an intermediate position thereof a projection 23*a* which extends in a radial direction from the band 17 and which is capable of making it easier to apply a pressure directed towards the base of the bottle to the band 17 in order to tear it or disengage it from the arms 12.

The band 17 may be provided with a take-up member 23*b*, preferably having a flap, to make it easier to grip the band 17 for the tearing or disengagement thereof from the arms 12. An example of a configuration of that flap is shown in FIG. 7.

Figure 7:
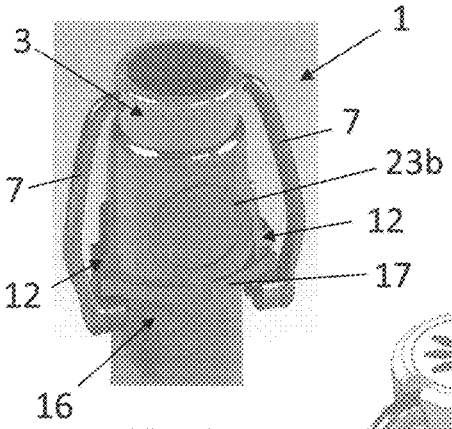
FIGS. 7 to 9 are perspective views of a partial bottle which is closed by additional embodiments of the mechanical closure according to the invention.

With reference to FIG. 7, the take-up member 23*b* extends from the band 17 in a substantially parallel manner with the longitudinal extent of the neck of the bottle when it is closed by the mechanical closure 1. That fact allows prevention of the presence of projections which could readily be exposed to occurrences of accidental contact which are capable of tearing the band 17 or disengaging it from the arms 12.

The take-up member 23*b* is preferably provided to rotate about the band 17 from the position substantially parallel with the longitudinal extent of the neck of the bottle to a position transverse relative thereto in order to make it easier to tear or disengage it from the arms 12 of the band 17.

In order to close the bottle 1, the arms 12 are oscillated so that the cap is pressed against the mouth of the bottle by means of a pressure which is applied by the pair of tie-rods. The arc 15 is then moved into contact with the neck C of the bottle shortly after the oscillation dead point is overcome. This ensures firm closure of the bottle, the opening of which requires the application of a sufficiently high force to allow the arc 15 to overcome the oscillation dead point in the direction away from the neck of the bottle.

With the bottle closed, the oscillation of the arms 17 about the respective pins is therefore prevented in a direction by the contact of the arc 15 with the neck of the bottle C and in the opposite direction by the contact between the neck and the band 17 which connects the arms 12 at the opposite side to the arc 15.

It is therefore evident that the removal of the cap 3 from the bottle may take place only after the arms 12 have been released following the removal or tearing of the tamper indicator 16 in accordance with one of the manners set out above.

After the arms 12 have been released, the mechanical closure 1 does not therefore have the band 17, or at least the band 17 is separated into two portions or detached from one of the two arms 12, therefore visibly damaged, thereby indicating the opening of the mechanical closure 1 even after subsequent occurrences of closure of the bottle.

The invention has a number of advantages with respect to conventional mechanical closures. These include the production of a closure which incorporates a tamper indicator which is reliable, robust and which clearly indicates the occurrence of the first opening of the bottle.

The invention claimed is:

1. A mechanical closure for a bottle comprising:

a cap hinged in an oscillating manner about an axis, a pair of tie-rods respectively articulated at their first end on opposite sides of the cap with respect to the axis and hinged at their opposite second end on a corresponding first end of a respective arm, each arm being provided at its second opposite end with a respective pin, the pins being coaxial and intended to hinge the arms on a neck of a-the bottle, the arms being connected to one another by an arc provided so that the arms may be jointly actuated to rotate about the respective pin, a tamper indicator provided to indicate the first opening of the mechanical closure;

wherein the tamper indicator comprises a band which interconnects the arms and/or the tie-rods on the side opposite the arc so as to prevent the arms from oscillating about the respective pins, wherein the band is interconnected at its opposite ends in respective seats provided in each of the arms and/or tie-rods and wherein the ends of the band are each provided with a hook, the seats being shaped so as to engage the hook.

2. A mechanical closure according to claim 1, wherein the band is interconnected with the arms and/or tie-rods in a position such that it is disposed, in use, at a shoulder present on the neck of the bottle.

3. A mechanical closure according to claim 1, wherein the band has a projection which extends in a radial direction from the band and is apt to make it easier to apply pressure to the band.

4. A mechanical closure according to claim 1, wherein the band comprises a take-up member to make it easier to grip the band.

5. A mechanical closure according to claim 1, wherein the band comprises one or a plurality of locally weakened areas.

6. A mechanical closure according to claim 1, wherein the band, arms, tie-rods and arc are produced by moulding from plastics material.

7. A mechanical closure according to claim 1, wherein the band is made in a colour contrasting with the arms, tie-rods and arc.

8. A mechanical closure according to claim 1, wherein the arms, tie-rods and arc are made from transparent material.

9. A mechanical closure according to claim 1, wherein the cap is made from foamed resin.

10. A mechanical closure for a bottle comprising:

a cap hinged in an oscillating manner about an axis, a pair of tie-rods respectively articulated at their first end on opposite sides of the cap with respect to the axis and hinged at their opposite second end on a corresponding first end of a respective arm, each arm being provided at its second opposite end with a respective pin, the pins being coaxial and intended to hinge the arms on a neck of the bottle, the arms being connected to one another by an arc provided so that the arms may be jointly actuated to rotate about the respective pin, a tamper indicator provided to indicate the first opening of the mechanical closure;

wherein the tamper indicator comprises a band which interconnects the arms and/or the tie-rods on the side opposite the arc so as to prevent the arms from oscillating about the respective pins, wherein the band is interconnected at its opposite ends in respective seats provided in each of the arms and/or tie-rods and wherein the seats are through-seats, the ends of the band each being provided with a one-way locking member in order to engage the respective seats.

11. A mechanical closure according to claim 10, wherein the band is interconnected with the arms and/or tie-rods in a position such that it is disposed, in use, at a shoulder present on the neck of the bottle.

12. A mechanical closure according to claim 10, wherein the band has a projection which extends in a radial direction from the band and is apt to make it easier to apply pressure to the band.

13. A mechanical closure according to claim 10, wherein the band comprises a take-up member to make it easier to grip the band.

14. A mechanical closure according to claim 10, wherein the band comprises one or a plurality of locally weakened areas.

15. A mechanical closure according to claim 10, wherein the band, arms, tie-rods and arc are produced by moulding from plastics material.

16. A mechanical closure according to claim 10, wherein the band is made in a colour contrasting with the arms, tie-rods and arc.

17. A mechanical closure according to claim 10, wherein the arms, tie-rods and arc are made from transparent material.

18. A mechanical closure according to claim 10, wherein the cap is made from foamed resin.

19. A mechanical closure for a bottle comprising:

a cap hinged in an oscillating manner about an axis, a pair of tie-rods respectively articulated at their first end on opposite sides of the cap with respect to the axis and hinged at their opposite second end on a corresponding first end of a respective arm, each arm being provided at its second opposite end with a respective pin, the pins being coaxial and intended to hinge the arms on a neck of the bottle, the arms being connected to one another by an arc provided so that the arms may be jointly actuated to rotate about the respective pin, a tamper indicator provided to indicate the first opening of the mechanical closure;

wherein the tamper indicator comprises a band which interconnects the arms between their first and second ends on a side opposite the arc so as to prevent the arms from oscillating about the respective pins.

20. A mechanical closure according to claim 19, wherein the band is interconnected with the arms in a position such that it is disposed, in use, at a shoulder present on the neck of the bottle.

* * * * *